United States Patent [19]

Lendl

[11] Patent Number: 4,589,788

[45] Date of Patent: May 20, 1986

[54] MECHANISM FOR RAISING AND TRANSPORTING OF PRINT AND CORRECTION RIBBONS

[75] Inventor: Joseph Lendl, Ottensoos, Fed. Rep. of Germany

[73] Assignee: Triumph-Adler, A.G., Nuremberg, Fed. Rep. of Germany

[21] Appl. No.: 678,357

[22] Filed: Dec. 5, 1984

[30] Foreign Application Priority Data

Dec. 9, 1983 [DE] Fed. Rep. of Germany ..... 3344595

[51] Int. Cl.[4] ..... B41J 33/14

[52] U.S. Cl. ..... 400/187; 400/212; 400/214; 400/225

[58] Field of Search ..... 400/211, 212, 214, 215, 400/216, 216.1, 216.2, 216.3, 223, 225, 226, 227, 227.2, 229, 232, 236, 236.1, 236.2, 697, 697.1, 185, 187

[56] References Cited

U.S. PATENT DOCUMENTS 4,347,007 8/1982 Schaefer ..... 400/697.1 X
4,472,073 9/1984 Valle et al. ..... 400/212 X

FOREIGN PATENT DOCUMENTS 126183 7/1983 Japan ..... 400/212

*Primary Examiner*—Charles A. Pearson

[57] ABSTRACT

Mechanism to raise and transport print and correction ribbons in typewriters and similar machines as a function of the direction of a rotation of a motor. The required motions are brought about by means of a cam wheel containing different cams and by appropriate cam followers, and provision is made to maintain ribbon raised to the typed line level so that during rapid printing only transport steps need to be carried out. It is also possible with the mechanism to effect transport steps of different size, to meet the requirements of the ribbon type used.

2 Claims, 3 Drawing Figures

Fig_1
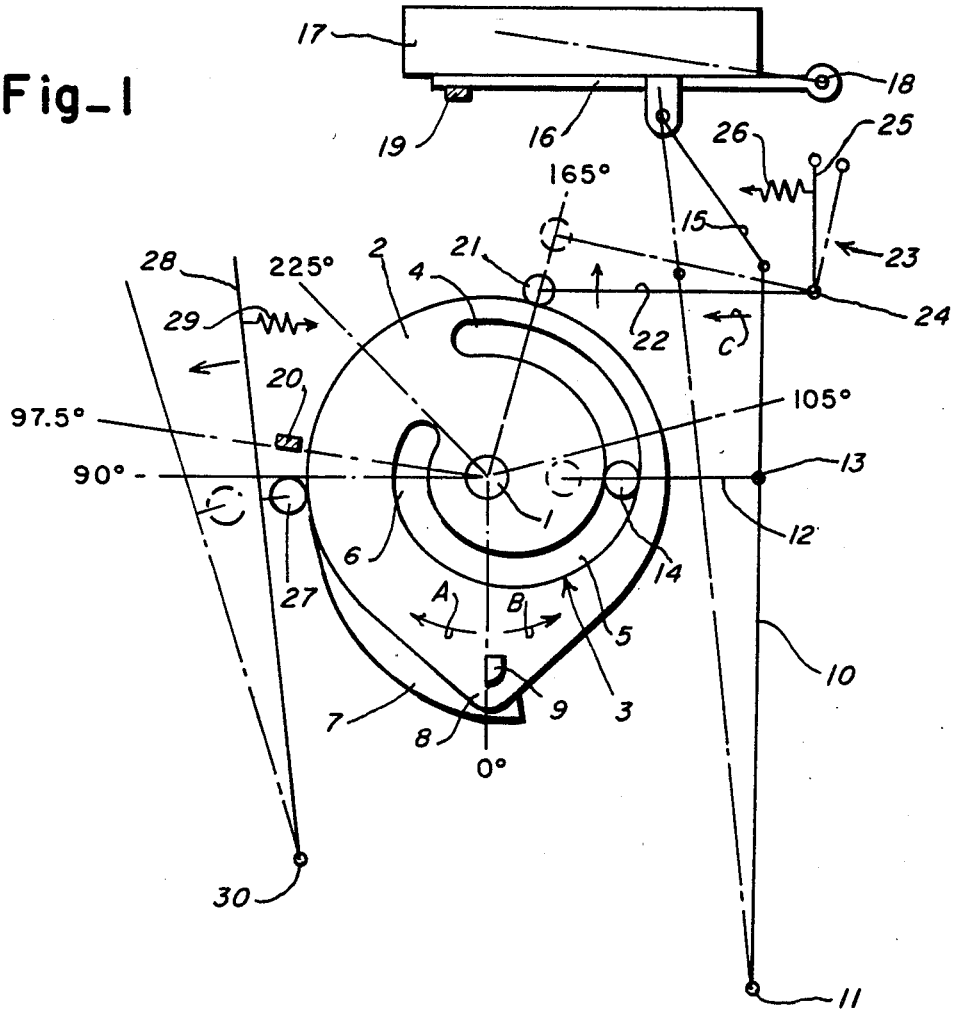
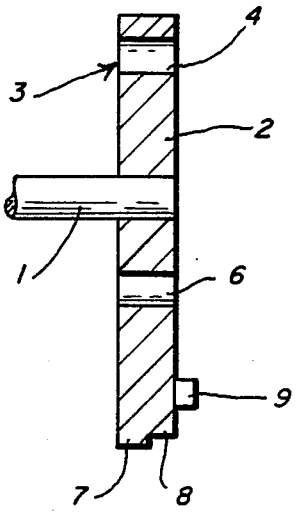
Fig_2
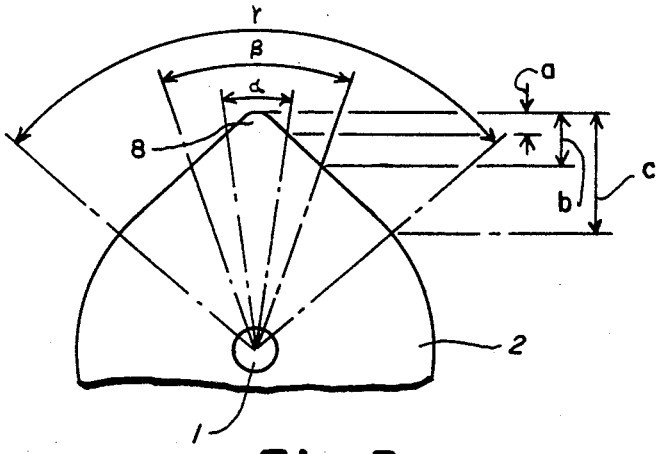
Fig_3

MECHANISM FOR RAISING AND TRANSPORTING OF PRINT AND CORRECTION RIBBONS

This invention relates to mechanism for raising and transporting print and correction ribbons in electronically controlled typewriters and similar machines.

BACKGROUND OF THE INVENTION

Known devices of this kind, such as disclosed in DE-PS No. 29 19 209, have proven useful in particular because a single power drive suffices for the respective functions of raising and transporting, selectively, a print or a correction ribbon. In U.S. Pat. No. 4,407,594 also showing a device of this kind, a magnet to switch from the one to the other operating mode is required in addition to a motor. However, in both of these known devices the print ribbon returns to its basic position after each reproduction of a character. This means a slower typing speed, which has a negative effect especially when the machine is used as printer in data processing or the like. Moreover, in a device according to the noted DE-PS No. 29 19 209, a relatively strong motor must be used because the type-wheel with its drive must also be raised together with the print and correction ribbons. This, too, influences the typing speed negatively.

Also in co-pending application of Manfred Hubner et al, Ser. No. 667,577, filed Nov. 2, 1984, titled Print and Correction Ribbon Drive System, mechanisms of the above kind are also disclosed wherein the various functions for both the print and correction ribbon are driven by a single motor. There, provision is made to maintain the ribbon at the typed line level when the machine is operated at high rates of printing, e.g., printer applications, while the transport steps are being carried out. However, in this mechanism, a special clutch and a precisely working change gear mechanism is required. In addition, quite a number of components are necessary which must be produced and assembled. Therefore, from the aspect of design, this mechanism is less suited for small typewriters intended for use in printer applications.

An object of the invention is in the provision of improved mechanism for raising and transporting print and correction ribbons requiring a relatively weak motor and which can be accomodated on the carriage of a type carrier.

Another object of the invention is in the provision of mechanism wherein the functions of raising and transporting the print ribbons are performed sequentially and wherein provision is made to maintain the print ribbon in raised position so that the motor need only drive the print ribbon transport during rapid printing.

Another object of the invention is in the provision of mechanism to raise and transport a print or a correction ribbon selectively by means of cams and cam followers according to the direction of rotation of a motor and in the provision for locking the print ribbon in raised position by means of the cam drive.

A still further object of the invention is in the provision of mechanism for raising and transporting print and correction ribbons by means of a motor driven cam and cam followers wherein the length of the transport steps is adjustable according to the angle through which the cam is driven.

Other objects, features, and advantages of the present invention will become better known to those skilled in the art from a reading of the following detailed description when taken in conjunction with the accompanying drawing wherein like reference numerals designate like or corresponding elements throughout the several views thereof and wherein:

FIG. 1 is a simplified, enlarged elavational view of mechanism according to the invention;

FIG. 2 is a longitudinal section of the cam wheel shown in FIG. 1; and

FIG. 3 is a partial view of the cam wheel illustrating different angular travel distances of the cam wheel for ribbon transport steps of different size.

Referring now to the drawing, there is shown in FIG. 1 a shaft 1 which is drivable directly or with the interposition of a transmission by a motor, preferably by a stepper motor driven by signals emanating from a programmed microcomputer in response to inputs from a keyboard or memory. The shaft 1 has secured thereto a cam wheel 2 which has a slot or groove formed therein defining a curved path 3 having three sectors 4, 5 and 6. The sectors 4 and 6 are circularly disposed relative to the shaft 1, but they are of different radii, sector 4 having a larger, and sector 6 a smaller one. Both sectors 4 and 6 are interconnected by sector 5. Disposed at the outside diameter of the cam wheel, as shown in FIG. 1, staggered in axial direction respectively, are a cam surface 7 whose radius increases from a 9 o'clock to a 6 o'clock position, and a symmetrical cam surface 8 of increasing radius from a 9 o'clock to six o'clock position and of decreasing radius to a three o'clock position. In addition, the cam wheel 2 has an axially protruding stop 9.

Associated with the cam wheel 2 are components described below which are shown only schematically by simple lines. For instance, 10 represents a print ribbon raising lever pivotable about a bearing 11. Linked to the lever 10 between its ends as at 13 is an arm 12. The free end of the arm 12 supports a roll 14 which projects into the curved path 3. The diameter of the roll 14 is selected so that it barely has clearance in the curved path 3. At the end of the lever 10 there pivots a coupling 15 whose other end is linked to the carrier 16 of a print ribbon cassette 17. The carrier 16 can pivot about a bearing 18. In its position at rest the carrier rests on a fixed bearing surface 19. This design of the transmission parts is not limiting in that the coupling 15 could also engage a ribbon guide (ribbon fork) in which case the cassette 17 need not be pivotally mounted.

In contact with the outer periphery of cam wheel 2 is a roll 21 axially located so that it can interact with the cam 8. This roll 21 is rotatably mounted to an arm 22 of an angular print ribbon transport lever 23 which can pivot about the bearing 24. The other arm 25 of the angular lever 23 is engaged by a spring 26 tending to pull the roll 21 in the arm 22 against the cam wheel 2. As will be described later, the purpose of the dual-armed lever 23 is the transmission of the transport motion of the mechanism to transport print ribbon in the print ribbon cassette 17. Various known transmission means may be provided for this purpose as for example, that shown in aforementioned U.S. Pat. No. 4,407,594 wherein a Bowden wire is used to actuate the transport pawl for a correction tape. Such a motion transmission could also be used for the ribbon according to the invention.

A roll 27 also contacts the cam wheel 2 in the area of the cam surface 7. Roll 27 is mounted to a pivoting lever 28 which is spring-loaded by a spring 29 and which is adapted to raise and transport a correction ribbon. This spring also tends to keep the roll 27 in constant contact with the cam wheel 2. The lever 28, pivotable about the bearing 30, transmits its motion to a correction device which may be designed, for instance, as described and illustrated in U.S. Pat. No. 4,411,542. Therefore, the correction ribbon carrier is not shown in the drawing.

Provided within the range of rotation of the stop 9 is a stop 20 fixed to the frame, which will be discussed later.

As is usual practice in electronically controlled typewriters using programmed microcomputers, when turning them on, a so-called starting routine is first initiated to bring the machine elements to a defined basic position. This applies also to the device according to the invention.

When starting the machine, the cam wheel 2 may be at any angular orientation. Therefore, when the machine is turned on, the starting routine will first cause the cam wheel 2 to turn in arrow direction A by means of the motor until stop 9 strikes the stationary stop 20. This causes the cam wheel 2 to stop. Since it is possible that this positioning requires almost 360°, the motor will be energized during the start routine by an appropriately long sequence of pulses. Thereafter the motor receives pulses to turn the cam wheel 2 in rotary direction B to the basic position shown in FIG. 1 at which the active surface of the stop 9 is at 0°. The pulse sequence to turn the cam wheel 2 from the stop 20 to the position 0° corresponds to an angle of 97.5° in the embodiment shown. In response to subsequent print or correction commands which produce stepper motor pulse sequences, the functions triggered from this basic position of the cam wheel 2 are determined by individual motor steps, the number of which according to the command is fixed in the microprogram of an electronic control circuit or microcomputer.

It is now assumed that a typing process is put in as the first command. The motor turns the cam wheel 2 from its basic position in arrow direction B with the result that the roll 14 of lever 10 is moved by means of the sector 5 of the curved path 3 from the sector 4 to the sector 6. In this process the lever 10 pivots in arrow direction C, whereby the carrier 16 of the print ribbon cassette 17, and with it the ribbon itself, is raised to the typed line by means of the coupling 15. This operation is concluded when the cam wheel 2 has made a 105° turn in arrow direction B. It is mentioned at this point that the data on angular distances are merely examples for better understanding of the invention. Other angular distances, therefore, may also be specified.

After the print ribbon cassette 17 is raised, the first reproduction of a selected character can take place following which the motor and the cam wheel 2 are turned further in arrow direction B, at the most by a 225° angle from the basic position of 0°. During the further turning from 105°, the cam 8 pivots the angular lever 23 which reaches its greatest deflection when the cam 8 passes through 165°. Consequently, the motion of the angular lever 23 affects the first transport step of the print ribbon. Now the cam wheel 2 can be turned back and forth alternately by the motor after each character reproduction between 105° and 225°, each time triggering a transport step when the cam 8 passes through the 165° angle. Therefore, typing can occur in rapid succession. The back and forth motion of the cam wheel 2 within the angular range mentioned remains without effect upon the rolls 14 and 27 and their levers 10 and 28, respectively, because the rolls 14 and 27 merely roll along circular paths of the cam wheel 2. Thus, the print ribbon is maintained in raised position.

The control whether or not the ribbon should remain raised can be predetermined by a timer in the control electronics. As long as the successive print commands occur within a fixed time span, the print ribbon will remain at the typed line level, and transport steps only are made. It is immaterial whether the print commands are made from a memory or through rapid manual input via a keyboard.

If the preset time is exceeded before a next following typed command, the timer causes the motor through a microprogram to turn the cam wheel 2 in arrow direction A until the position 0° is reached again. Then motor and cam wheel 2 will stop. During the return of the cam wheel 2 the lever 10 is also reset again and the ribbon is lowered by means of the coupling 15.

The above described process is repeated upon the arrival of a new printing command.

If from the 0° position a correction command is put into the machine, the electronic control circuit causes the motor to turn the cam wheel 2 by 90° in arrow direction A. This pivots the lever 28 via the cam surfce 7 and the roll 27 and raises the correction tape carrier. According to the above noted U.S. Pat. No. 4,411,542, the transport of the correction tape can be carried out at the same time. After a correction is made, the cam wheel 2 is returned again and stopped in the 0° position. If several characters need correction, these two processes just described are repeated. The rotary motion of the cam wheel 2 in arrow direction A remains without effect upon the rolls 14 and 21 because they merely rest on circular paths.

The separation of the print ribbon raising and ribbon transporting functions permits the use of a relatively weak motor. During the correcting operation, on the other hand, both functions can take place simultaneously because they require the movement of far lighter masses than are required to move the print ribbon.

Referring now to FIG. 3, there is shown how the mechanism can effect different transport steps for the print ribbon. The magnitude of the pivoting motion of the angular lever 23 determines the size of the transport step for the print ribbon. On this basis it can be determined which angular distance the cam 8 must travel to carry out a certain transport step. In FIG. 3 the cam 8 is shown in an assumed 165° position from FIG. 1, in which the angular lever 23 is at its greatest deflection. If only an angle alpha is traveled during the forward and return rotation of the cam wheel 2 for the assumed position, this results in a deflection a of the angular lever 23. This means that only a small transport step is carried out, such as required for a multi-strike carbon ribbon, for instance. In accordance with the other angles beta and gamma, the deflections b and c of the angular lever 23 can be determined, which bring about a correspondingly longer transport step for the ribbon. Accordingly, any number of transport steps of different size can be predetermined within certain limits.

The steps required for the motor rotation to carry out the rotation angles alpha, beta, and gamma can be fixed in a microprogram. The selection of the respective microprogram can be made either through a keyboard switch or through design feartures of the ribbon cassette. Since in this embodiment of the device the cam wheel 2 need be turned back and forth by a few angular degrees only when certain kinds of ribbon are used, another increase of the printing speed results.

The invention claimed is:

1. In an electronically controlled typewriter having print and correction ribbons and motor driven mechanism for raising and transporting said print and correction ribbons in response to print and correction commands respectively, said mechanism comprising a single cam wheel mounted on a bidirectionally motor driven shaft rotatable in response to a print command for rotation from an initial position in a first direction to a first predetermined angle, thereafter to a second predetermined angle, and thereafter either back to said intial position, if a subsequent print command does not follow within a predetermined time interval, or back and forth between said first and second predetermined angle in response to subsequent print commands which follow within a predetermined time interval, said cam wheel having first and second can surfaces, a first cam follower mounted to be driven by said first cam surface and connected to raise said print ribbon, and a second cam follower mounted to be driven by said second cam surface and connected to effect transport of said print ribbon, said first and second cam surfaces being disposed and configured to drive said first cam follower during rotation of said cam wheel to said first predetermined angle and, after printing, to drive said second cam follower during rotation of said cam wheel to said second predetermined angle and thereafter, back and forth during rotation of said cam wheel between said first and second predetermined angle in response to subsequent print commands which follow within a predetermined time interval, whereby said print ribbon will remain raised and only ribbon transport steps will be effected by said second cam follower, said second cam surface having a symetrical configuration with its maximum lift substantially midway between said first and second predetermined angles, and said first and second predetermined angles being established according to the type of print ribbon selected for use to control the length of the ribbon transport steps.

2. In an electronically controlled typewriter as recited in claim 1, said cam wheel being rotatable from said initial position in a second direction to a third predetermined angle and back in response to a correction command, a third cam surface on said cam wheel, and a third cam follower mounted to be driven by said third cam surface and connected to raise and effect transport of said correction ribbon during rotation of said cam wheel to said third predetermined angle, said first and second cam surface configurations being without effect on their respective cam followers during rotation of said cam wheel in said second direction from and back to said initial position.

* * * * *